United States Patent [19]

Krings et al.

[11] 4,215,007

[45] Jul. 29, 1980

[54] PROCESS FOR THE MANUFACTURE OF LOW-PHOSPHORUS OR PHOSPHORUS-FREE DETERGENTS CONTAINING ALUMINOSILICATES

[75] Inventors: Peter Krings, Krefeld; Josef Huppertz, Dusseldorf-Holthausen; Herbert Latka, Neuss; Gerhard Sperling, Hilden; Milan J. Schwuger, Haan; Heinz Smolka, Langenfeld, all of Fed. Rep. of Germany

[73] Assignee: Henkel Kommanditgesellschaft auf Aktien (Henkel KGaA), Dusseldorf-Holthausen, Fed. Rep. of Germany

[21] Appl. No.: 948,219

[22] Filed: Oct. 3, 1978

Related U.S. Application Data

[63] Continuation of Ser. No. 592,924, Jul. 3, 1975, abandoned.

[30] Foreign Application Priority Data

Jul. 4, 1974 [AT] Austria ..... 5522/74

[51] Int. Cl.[2] ..... C02B 1/44; C11D 3/12; C11D 11/00; C11D 11/02

[52] U.S. Cl. ..... 252/174.25; 23/313 R; 23/313 AS; 159/4 R; 252/131; 252/135; 252/140; 252/174.21; 252/179; 252/540; 252/559

[58] Field of Search ..... 252/89, 131, 135, 140, 252/179, 174.25, 540, 559, 174.21; 23/313 R, 313 AS; 159/4 R

[56] References Cited

U.S. PATENT DOCUMENTS

| | | | |
|---|---|---|---|
| 3,783,008 | 1/1974 | Weldes | 252/135 X |
| 3,819,526 | 6/1974 | Pierce | 252/135 |
| 3,918,921 | 11/1975 | Pierce | 252/135 X |
| 3,925,262 | 12/1975 | Laughlin | 252/526 |
| 4,083,793 | 4/1978 | Jakobi | 252/99 |

FOREIGN PATENT DOCUMENTS

| | | | |
|---|---|---|---|
| 2422655 | 11/1974 | Fed. Rep. of Germany | 252/131 |

*Primary Examiner*—Dennis L. Albrecht
*Attorney, Agent, or Firm*—Hammond & Littell, Weissenberger & Muserlian

[57] ABSTRACT

A process for the manufacture of low-phosphorus or phorphorus-free spray dried detergents containing at least one water-soluble inorganic or organic compound exerting a washing or cleansing effect and at least one compound inhibiting alkaline earth metal ion precipitation comprising a finely-dispersed, water-insoluble, bound water-containing silicate compound having a calcium-binding power of at least 50 mg CaO/gm of anhydrous active substance and having the formula, combined water not shown, $$(M_{2/n}O)_x \cdot Me_2O_3 \cdot (SiO_2)_y$$

where M is a cation of the valence n, exchangeable with calcium, x is a number of from 0.7 to 1.5, Me is a member selected from aluminum and boron and y is a number of from 0.8 to 6, comprising spraying an aqueous slurry containing at least 50% by weight of the total solids of the final spray dried detergent into a conventional spray drier and simultaneously injecting at the area of the spray cone at least 25% of the total amount of said bound water-containing silicate compound, as a powder.

8 Claims, No Drawings

PROCESS FOR THE MANUFACTURE OF LOW-PHOSPHORUS OR PHOSPHORUS-FREE DETERGENTS CONTAINING ALUMINOSILICATES

This is a continuation of Ser. No. 592,924, filed July 3, 1975 and now abandoned.

THE PRIOR ART

Until now in detergent formulation, phosphates have been employed for the complexing of calcium. Hence, the partial or total replacement of the phosphates with other substances having similar properties constitutes a problem for the detergent industry at present. Copending commonly-assigned United States patent applications Ser. No. 458,306, filed Apr. 5, 1976, now abandoned in favor of continuation Ser. No. 800,308, filed May 25, 1977; Ser. No. 458,326, filed Apr. 5, 1974, now abandoned in favor of continuation Ser. No. 723,728, filed Sept. 16, 1976, now U.S. Pat. No. 4,083,793; and Ser. No. 458,303, filed Apr. 5, 1974, now abandoned in favor of continuation Ser. No. 813,436, filed July 7, 1977 describe detergents containing, as compounds capable of binding calcium, at least one finely-dispersed water-insoluble silicate compound containing at least some combined water and having a calcium binding power of at least 50 mg CaO/gm of anhydrous active substance and the formula on the anhydrous basis $$(M_{2/n}O)_x.Me_2O_3.(SiO_2)_y$$

where M is a cation of the valence n, exchangeable with calcium, x is a member of from 0.7 to 1.5, Me is a member selected from the group consisting of aluminum and boron, and y is a number from 0.8 to 6.

The calcium binding power of the silicate compounds can be as high as 200 mg CaO/gm of anhydrous active substance (AS) and preferably is in the range of 100 to 200 mg CaO/gm AS.

The cation M employed is preferably sodium. However the same can also be totally or partially replaced by other cations exchangeable with calcium, such as lithium, potassium, ammonium or magnesium, as well as by the cations of water-soluble organic bases, for example, by those of primary, secondary or tertiary alkylamines or alkylolamines with not more than 2 carbon atoms per alkyl radical, or not more than 3 carbon atoms per alkylol radical.

The detergents produced by these processes however, suffer the drawback in that their particle size range is not as uniform as is desired.

OBJECTS OF THE INVENTION

An object of the present invention is the development of a process for the manufacture of a low-phosphorus or phosphorus-free spray dried detergent powder containing at least one water-soluble inorganic or organic compound exerting a washing or cleansing effect and at least one finely-dispersed, water-insoluble silicate compound containing at least some combined water and having a calcium binding power of at least 50 mg CaO/gm of anhydrous active substance and the formula on the anhydrous basis $$(M_{2/n}O)_x.Me_2O_3.(SiO_2)_y$$

where M is a cation of the valence n, exchangeable with calcium, x is a member of from 0.7 to 1.5, Me is a member selected from the group consisting of aluminum and boron, and y is a number from 0.8 to 6, comprising the steps of spraying an aqueous slurry of at least 50% by weight of the total solids of the final spray dried detergent, of detergent ingredients including said compound exerting a washing or cleansing effect and possibly some of said silicate compound, into a fall space while passing a large volume of air therethrough at an inlet temperature in excess of 150° C. and simultaneously injection into said fall space, a powder comprising at least 25% by weight of the total amount of said silicate compound, at a rate in proportion to the rate of said spraying whereby the desired solids ratio of ingredients in said spray dried detergent powder is maintained, and recovering said spray dried detergent powder.

A further object of the present invention is the obtaining of an improved spray dried detergent powder by the above process.

These and other objects of the present invention will become more apparent as the description thereof proceeds.

DESCRIPTION OF THE INVENTION

The above objects have been achieved and the drawbacks of the prior art have been avoided by the practice of the present invention. The invention relates to a process in which low-phosphate or phosphate-free detergents containing aluminosilicates as well as at least one water-soluble inorganic or organic compound exerting a washing or cleansing effect are manufactured by spray drying of the aqueous batch of a part of the components of the agent to be prepared. The process is characterized in that at least part of the powdery aluminosilicates is set aside and that during the spray drying of an aqueous slurry containing the remaining components, the aluminosilicate set aside is introduced as a powder into the space in which the sprayed particles are dried.

More particularly, the present invention relates to a process for the manufacture of a low-phosphorus or phosphorus-free spray dried detergent powder containing at least one water-soluble inorganic or organic compound exerting a washing or cleansing effect and at least one finely-dispersed, water-insoluble silicate compound containing at least some combined water and having a calcium binding power of at least 50 mg CaO/gm of anhydrous active substance and the formula on the anhydrous basis $$(M_{2/n}O)_x.Me_2O_3.(SiO_2)_y$$

where M is a cation of the valence n, exchangeable with calcium, x is a member of from 0.7 to 1.5, Me is a member selected from the group consisting of aluminum and boron, and y is a number from 0.8 to 6, comprising the steps of spraying an aqueous slurry of at least 50% by weight of the total solids of the final spray dried detergent, of detergent ingredients including said compound exerting a washing or cleansing effect and possibly some of said silicate compound, into a fall space while passing a large volume of air therethrough at an inlet temperature in excess of 150° C. and simultaneously injecting into said fall space, a powder comprising at least 25% by weight of the total amount of said silicate compound, at a rate in proportion to the rate of said spraying whereby the desired solids ratio of ingredients in said spray dried detergent powder is maintained, and recovering said spray dried detergent powder; as well as the product produced by the process.

The compounds which have been defined above and are capable of binding calcium are subsequently designated as "aluminosilicates" for reasons of simplification. This especially applies to the sodium aluminosilicates which are preferably to be employed. However, all statements made for their manufacture and processing are valid for the totality of the above-defined compounds.

The cation M present in the aluminosilicates to be processed according to the invention preferably is sodium. However, it can be replaced with alkali metals, such as lithium and potassium, or ammonium, or magnesium as well as with the cations of water-soluble bases, for example, those of primary, secondary or tertiary alkylamines or alkylolamines having at the most, two carbon atoms per alkyl residue or at the most, three carbon atoms per alkylol residue.

The above-defined aluminosilicates can be produced synthetically in a simple manner, for example, by reacting water-soluble silicates with water-soluble aluminates in the presence of water. To this end aqueous solutions of the starting materials can be mixed with each other, or one component which is present in solid form can be reacted with another component which is present as an aqueous solution. The desired aluminosilicates can also be obtained by mixing both solid components in the presence of water. Aluminosilicates can also be produced from $Al(OH)_3$, $Al_2O_3$ or $SiO_2$ by reaction with alkali metal silicate or alkali metal aluminate solutions, respectively. Finally, such substances are also formed from the melt, but this method seems of less economical interest because of the required high melting temperature and the necessity of transforming the melt into finely-dispersed products.

The cation-exchanging aluminosilicates to be used according to the invention are only formed if special precipitation conditions are maintained, otherwise products are formed which have no, or an inadequate, calcium exchanging power. The calcium exchanging power of at least 50 mg CaO/gm of anhydrous active substance (AS) is critical to the present process. If aluminosilicates are employed with below the critical limit of calcium exchanging power, very little if any soil removal from the soiled textiles is effected in the absence of other types of calcium sequestering or precipitating agents. The production of useable aluminosilicates according to the invention is described in the experimental part.

The aluminosilicates in aqueous suspension produced by precipitation or by transformation in finely-dispersed form according to other methods can be transformed from the amorphous into the aged or into the crystalline state by heating the suspension to temperatures of 50° to 400° C. However, there is hardly any difference between these two forms as far as the calcium binding power is concerned. Aside from the drying conditions, the calcium binding power of the aluminosilicates is proportional to the amount of aluminum contained therein with reference to the amount of silicon. Nevertheless, the crystalline aluminum silicates are preferred for the purpose of the invention. The preferred calcium binding power, which is in the range of 100 to 200 mg CaO/gm AS, is found primarily in compounds of the composition:

$$0.7 \text{ to } 1.1\ Na_2O.Al_2O_3.\ 1.3 \text{ to } 3.3\ SiO_2$$

This summation formula comprises two types of different crystal structures (or their non-crystalline initial products) which also differ by their summation formulas. These are:

(a) $0.7 \text{ to } 1.1\ Na_2O.Al_2O_3.\ 1.3 \text{ to } 2.4\ SiO_2$ (b) $0.7 \text{ to } 1.1\ Na_2O.Al_2O_3.>2.4 \text{ to } 3.3\ SiO_2$ The different crystal structures can be seen in the X-ray diffraction diagram. The d-values found are given in the examples in the description of the production of the aluminosilicates XII and II.

The amorphous or crystalline aluminosilicate contained in the aqueous suspension can be separated by filtration from the remaining aqueous solution and be dried at temperatures of 50° to 800° C., for example. Depending on the drying conditions, the product contains more or less combined water. Anhydrous products are obtained by drying at 800° C. If we want to remove the water completely, this can be done by heating for 1 hour to 800° C. This is the way the AS contents of the aluminosilicates are also determined.

Such high drying temperatures are not recommended for the aluminosilicates to be used according to the invention, preferably the temperature should not exceed 400° C. It is of particular advantage that even products dried at substantially lower temperatures of 80° to 200° C., for example, until the adhering liquid water is removed, can be used for the purposes of the invention. The aluminosilicates thus produced, which contain varying amounts of combined water, are obtained after the disintegration of the dried filter cake, as fine powders whose primary particle size does not exceed 0.1 mm, but is mostly lower and ranges down to dust fineness, for example, to 0.1$\mu$. It must be kept in mind that the primary particles can be agglomerated to larger structures. In some production methods primary particle sizes ranging from 30 to 1$\mu$ are obtained.

Of particular advantage are aluminosilicates having at least 80% by weight of particles of 10 to 0.01$\mu$, preferably 8 to 0.1$\mu$. These aluminosilicates preferably contain no primary or secondary particles above 30$\mu$. As far as the products are crystalline, they are "micro-crystalline."

The formation of smaller particle sizes can already be enhanced by the precipitation conditions. For these smaller particle sizes, the intermixed aluminate and silicate solutions, which can also be introduced simultaneously into the reaction vessel, are subjected to great shearing forces. If crystalline aluminum silicates are produced, which are preferred according to the invention, the formation of larger or inter-penetrating crystals is prevented by slowly stirring the crystallizing mass.

Nevertheless, undesired agglomeration of crystal particles can occur during the drying, so that it is advisable to remove these secondary particles in a suitable manner, for example, by air sifting. Aluminosilicates obtained in coarser form, which are ground to the desired particle size, can also be used. Suitable for this purpose are, for example, mills and/or air sifters or combinations thereof. The latter are described, for example, in Ullmann, "Enzyklopädie der Technischen Chemie", Vol. 1, 1951, pp. 632 to 634.

From the sodium aluminosilicates, aluminosilicates of other cations, for example, those of potassium, magnesium or water-soluble organic bases can be produced in a simple manner by the exchange of bases. The use of these compounds instead of the sodium aluminosilicates may be of advantage if a special effect is to be achieved by the supply of the said cations, for example, if the state of dissolution of different surface-active compounds simultaneously present in the composition is to be influenced.

In addition to the aluminum-to-silicon ratio, the particle size of the aluminosilicates and their state of aging or crystallization can affect their calcium binding power. As indicated, preferably, products having a calcium binding power within the range of 100 to 200 mg CaO/gm AS are used and of these, the crystalline types are preferred.

The special advantage of the process according to the invention consists in that with respect to the drying of the aluminosilicates which have been obtained in a moist state after the precipitation or the crystallization and with respect to the drying of the aqueous slurry of the remaining components of the detergent, it is possible to maintain the drying conditions which in each case are optimally adjusted for the product to be manufactured. The larger the amounts of aluminosilicates which are kept out of the aqueous slurry to be dried by heat, in order to be introduced as a dry powder, the more the amounts put through the drying apparatus can be increased. Therefore, the quantity of aluminosilicate to be introduced as powder should amount to at least $\frac{1}{4}$, preferably to $\frac{1}{3}$, of the total quantity of aluminosilicate to be incorporated.

An additional advantage of the process according to the invention consists in that the aluminosilicates to be introduced as a powder can to a certain extent be charged or mixed with oily or paste-like non-ionic, surface-active compounds without thereby losing their good powdery qualities. For example, up to 0.3 part by weight of non-ionic, surface-active compounds can be incorporated per 1 part by weight of aluminosilicate without greatly affecting the powdery characteristics of the aluminosilicate.

During the spray drying, the aqueous slurry of a part of the detergent composition is sprayed through nozzles or by centrifugal action, such as by delivering the aqueous slurry to a rotating disk. In this way, the said slurry is transformed into a fine stream of particles and in this form is brought into contact with hot gases at about 200° C. to 300° C. so that the particles are dried. For this purpose, spray towers are preferably employed into the upper part of which the nozzles have been placed. The hot drying gas is passed in the same direction as the sprayed liquid slurry or is passed countercurrently.

The aluminosilicate powder can be introduced at any place whatsoever into the spraying or fall space, but it has to be as finely divided as possible. Preferably, it is blown in with air so that the aluminosilicate powder and the spray dried powder are intimately mixed. Moreover, when the aluminosilicate powder is introduced at a place at which the particles of the sprayed batch are still moist, then the latter bind the aluminosilicate powder forming agglomerates. For this purpose, for example, the close surroundings of the spraying nozzles in the area of the spraying cone are suitable as the inlet point for the aluminosilicate powder.

The aqueous batch which is to be spray dried contains first of all the water-soluble components of the end product to be manufactured which are stable under the respective processing conditions and which are non-volatile. This includes anionic, zwitterionic, and non-ionic, surface-active compounds and complexing or non-complexing builder salts, all of which exert a washing or cleaning effect, as well as, optionally, a part of the aluminosilicate.

As is known, the surface-active compounds contain in their molecule at least one hydrophobic residue and one hydrophilic anionic, zwitterionic, or non-ionic group. In most cases, the hydrophobic residue is an aliphatic hydrocarbon residue having 8 to 26, preferably 10 to 22, especially 12 to 18, carbon atoms, or the hydrophobic residue is an alkylaromatic residue having 6 to 18, preferably 8 to 16, aliphatic carbon atoms.

The usable anionic, surface-active compounds comprise those typified by soaps, alkylbenzenesulfonates, mixtures of alkenesulfonates, hydroxyalkanesulfonates, and alkanedisulfonates which are accessible via the sulfonation of olefins, furthermore, alkanesulfonates as well as esters of α-sulfo-higher-fatty acids, as for example, the α-sulfo-fatty acids produced from hydrogenated methyl or ethyl esters of coconut fatty acids, palm-kernel fatty acids, or tallow fatty acids. Additional suitable anionic surface-active compounds are the monoesters of sulfuric acid with primary or secondary alcohols, for example, those with coconut fatty alcohols, tallow fatty alcohols, oleyl alcohol, or with secondary alcohols accessible via the oxidation of paraffins, as well as addition products obtainable by the addition of 1 to 5 mols of ethylene oxide to said alcohols. The anionic surface-active compounds can be present as the alkali metal salts such as sodium or potassium or ammonium salts, as well as water-soluble salts of organic bases, such as alkylamines and alkylolamines having up to three carbon atoms in each chain, for example, as the salts of mono, di or triethanolamines.

Usable non-ionic, surface-active compounds are preferably those of the polyoxyalkylene glycol derivatives, such as the products obtained by the addition of 4 to 40, preferably 4 to 20, mols of ethylene oxide to 1 mol of a higher fatty alcohol, vicinal higher alkanediol, higher alkylphenol, or higher fatty acid. Especially important are the addition products of 1 to 16 mols of ethylene oxide to coconut fatty alcohols or tallow fatty alcohols, oleyl alcohol, or secondary alcohols having 8 to 18, preferably 12 to 18, carbon atoms, as well as the adducts with mono or dialkylphenols having 6 to 14 carbon atoms in the alkyl residues.

In addition to these water-soluble non-ionic, surface-active compounds, also of interest are the polyoxyethylene glycol ethers having 1 to 4 ethylene oxide units in the molecule which are not water-soluble or not completely soluble in water, especially when they are used together with the water-soluble non-ionic or anionic, surface-active compounds.

Non-ionic surface-active compounds of the type of amineoxides or sulfoxides can likewise be employed.

The zwitterionic surface-active compounds include substances of the type of carboxybetaines or sulfobetaines.

Suitable builder salts are compounds which are capable of complexing calcium as well as compounds which do not possess this power. The latter include, for example, alkali metal bicarbonates, alkali metal carbonates, alkali metal borates, or alkali metal silicates, alkali metal sulfates, as well as the alkali metal salts of organic sulfonic, carboxylic and sulfocarboxylic acids which contain 1 to 8 carbon atoms and which are not surface-active. Examples of these are the water-soluble salts of benzenesulfonic acid, toluenesulfonic acid, or xylenesulfonic acids, as well as the water-soluble salts of sulfoacetic acid, sulfobenzoic acid, or sulfodicarboxylic acids. Suitable complexing builder salts are the polymeric phosphates, such as alkali metal tripolyphosphates and a great number of known organic complexing agents, typified by polycarboxylic acids under which polymeric carboxylic acids, aminopolycarboxylic acids, polyphosphonic acids, phosphonocarboxylic acids, hydroxypolycarboxylic acids, carboxyalkyl ethers, etc., are also classed.

Insofar as the products of the invention comprise compounds containing phosphorus, the total phosphorus content of the agents should amount to not more than 6%, preferably at the most 3%.

The composition of the spray dried products to be prepared according to the invention lies, in general, within the range of the following formulations.

- 5% to 30% by weight of anionic and/or non-ionic and/or zwitterionic surface-active compounds,
- 5% to 50% by weight of aluminosilicates (based on the powdery products which preferably contain bound water),
- 15% to 90% by weight of water-soluble complexing and/or non-complexing builder salts,
- 0 to 50% by weight of bleaching agents and other additives, such as optical brighteners, soil suspension agents, enzymes, foam inhibitors, perfumes, dyes, etc., which are generally present in such products, as well as about 10% by weight of water.

Suitable bleaching agents are compounds which yield $H_2O_2$ in aqueous solution, such as, for example, alkali metal perborates or substances supplying active chlorine. Other additives which are mostly present in small amounts are, for example, foam stabilizers or foam inhibitors, textile softeners, bleaching stabilizers, and/or bleaching activators, corrosion inhibitors, antimicrobial substances, soil suspension agents, enzymes, optical brighteners, dyes, perfumes, etc.

The products manufactured according to the invention can be applied for various purposes of detergency in numerous technological fields and in the household. Examples for such fields of application are the cleaning of utensils, containers made of wood, plastic, metal, ceramics, glass, etc., performed in industry or in service shops, the cleaning of furniture, walls, floors, articles made of ceramics, glass, metal, wood, plastic, the cleaning of polished or varnished surfaces in the household, etc. An especially important field of application is the washing of textiles of all kinds in industry, in commercial laundries, and in households.

The following specific embodiments are illustrative of the invention without being limitative in any respect.

EXAMPLES

First, the production of the finished alumino silicates is described, for which no invention is claimed.

PROCESS CONDITIONS

The aluminate solution, diluted with deionized water was mixed in a vessel of 15 liter capacity, under vigorous stirring with the silicate solution. Both solutions were at room temperature. An X-ray amorphous sodium aluminosilicate was formed in the exothermic reaction as a primary precipitation product. After stirring for 10 minutes, the suspension of the precipitation product was either separated as an amorphous product or transferred to a crystallization vessel where it remained for some time at the elevated temperature given to crystallize. After draining off the liquor from the amorphous product or the crystals and washing with deionized water until the outflowing wash water had a pH value of about 10, the filter residue was dried at 80° C. under 100 mm Hg pressure for 3 hours. When there is any deviation from this general production procedure, this is mentioned explicitly in the specific part. Thus, for example, in some cases for the practical tests, the homogenized uncrystallized suspension of the precipitation product or the crystal sludge was used. In the case of the aluminosilicates which had not been modified with cationics, the water content was determined by heating the product for one hour to 800° C.

In the production of microcrystalline aluminosilicates, indicated by the suffix "m", the aluminate solution diluted with deionized water was mixed with the silicate solution and mixed in a high speed intensive stirrer (10,000 rpm, "Ultraturrax", made by Janke & Kunkel IKA-Werk, Stauffen/Breisgau, Federal Republic of Germany). After vigorous stirring for 10 minutes, the suspension of the amorphous precipitation product was transferred to a crystallization vessel where the formation of large crystals was prevented by stirring the suspension. After draining off the liquor and washing with deionized water until the outflowing water had a pH value of about 10, the filter residue was dried, then ground in a ball mill and separated in a centrifugal sifter ("Microplex" Air Sifter, made by Alpine, Augsburg, Federal Republic of Germany) into two fractions, of which the finer fraction contained no portions above 10$\mu$. The particle size distribution was determined by means of a sedimentation scale.

The degree of crystallization of an aluminosilicate can be determined from the intensity of the interference lines of an X-ray diffraction diagram of the respective product, compared to the corresponding diagrams of X-ray amorphous or fully crystallized products.

All data in % are in percent by weight.

The calcium binding power of the aluminosilicates or borosilicates was determined in the following manner. One liter of an aqueous solution, containing 0.594 gm of $CaCl_2$ (=300 mg CaO/l=30° dH) and adjusted to a pH of 10 with diluted NaOH, was mixed with 1 gm of the aluminosilicate or borosilicate (on the anhydrous basis, AS). Then the suspension was stirred vigorously for 15 minutes at a temperature of 22° C. (±2° C.). After filtering off the aluminosilicate, the residual hardness x of the filtrate was determined. From it, the calcium binding power was calculated in mg CaO/gm. As according to the formula: (30−x).10. For short hand purposes the above procedure is hereinafter referred to as the Calcium Binding Power Test Method.

If calcium binding power is determined at higher temperature, for example, at 60° C., better values are obtained than at 22° C. This fact distinguishes the aluminosilicates from most of the soluble sequestering agents that have been suggested so far for use in detergents and represents a particular technical progress in their use.

| Product conditions for aluminosilicate II: | |
|---|---|
| Precipitation: | 2.115 kg of an aluminate solution of the composition: 17.7% $Na_2O$ 15.8% $Al_2O_3$, 66.5% $H_2O$<br>0.585 kg of sodium hydroxide<br>9.615 kg of water<br>2.685 kg of a 25.8% sodium silicate solution of the composition: 1 $Na_2O$ . 6 $SiO_2$ (prepared as under I) |
| Crystallization: | 24 hours at 80° C. |

-continued

| Product conditions for aluminosilicate II: | |
|---|---|
| Drying: | 24 hours at 100° C. and 20 Torr. |
| Composition: | 0.8 $Na_2O$ . 1 $Al_2O_3$ . 2.655 $SiO_2$ . 5.2 $H_2O$ |
| Degree of crystallization: | Fully crystalline |
| Calcium binding power: | 120 mg CaO/gm AS. |

This product too can be dehydrated by drying (for 1 hour at 400° C.) to the composition:

0.8 $Na_2O$. 1 $Al_2O_3$. 2.65 $SiO_2$. 0.2 $H_2O$

This dehydration product IIa is likewise suitable for the purposes of the invention.

| Production conditions for aluminosilicate V: | |
|---|---|
| Precipitation: | 4.17 kg of solid aluminate of the composition: 38% $Na_2O$, 62% $Al_2O_3$<br>10.83 kg of a 34.9% sodium silicate solution of the composition: 1 $Na_2O$ . 3.46 $SiO_2$ |
| Crystallization: | None, amorphous precipitate |
| Drying: | 24 hours at 100° C. |
| Composition: | 1.5 $Na_2O$ . 1 $Al_2O_3$ . 2 $SiO_2$ . 3 $H_2O$ |
| Degree of crystallization: | X-ray amorphous |
| Calcium binding power: | 140 mg CaO/gm AS |

| Production conditions for aluminosilicate XII: | |
|---|---|
| Precipitation: | 2.01 kg of an aluminate solution of the composition: 20.0% $Na_2O$, 10.2% $Al_2O_3$, 69.8% $H_2O$<br>1.395 kg of sodium hydroxide<br>9.045 kg of water<br>2.19 kg of a 25.8% sodium silicate solution of the composition: 1 $Na_2O$ . 6 $SiO_2$<br>prepared freshly from commercial waterglass and easily alkali-soluble silica |
| Crystallization: | 24 hours at 80° C. |
| Drying: | 24 hours at 100° C. |
| Composition: | 0.9 $Na_2O$ . 1 $Al_2O_3$ . 2 $SiO_2$ . 3 $H_2O$ |
| Degree of crystallization: | Fully crystalline |
| Calcium binding power: | 160 mg CaO/gm AS |

The aluminosilicates XII and II show in the X-ray diffraction diagram the following interference lines:

| d-values, recorded with Cu—$K_\alpha$-radiation in A | |
|---|---|
| XII | II |
| — | 14.4 |
| 12.4 | — |
| — | 8.8 |
| 8.6 | — |
| 7.0 | — |
| — | 4.4 (+) |
| 4.1 (+) | — |
| — | 3.8 (+) |
| 3.68 (+) | — |
| 3.38 (+) | — |
| 3.26 (+) | — |
| 2.96 (+) | — |
| — | 2.88 (+) |

-continued

| d-values, recorded with Cu—$K_\alpha$-radiation in A | |
|---|---|
| XII | II |
| — | 2.79 (+) |
| 2.73 (+) | — |
| — | 2.66 (+) |
| 2.60 (+) | — |

It is quite possible that not all these interference lines will appear in the X-ray diffraction diagram, particularly if the aluminosilicates are not fully crystallized. For this reason, the d-values which are the most important for the characterization of these types are identified by a "(÷)".

The primary particle sizes of the above aluminosilicates range from 10 to 45 mμ.

| Production conditions for aluminosilicate IIm: | |
|---|---|
| Precipitation: | As for aluminosilicate II |
| Crystallization: | 12 hours at 90° C. |
| Drying: | 24 hours at 100° C. and 20 torr. |
| Composition: | 0.8 $Na_2O$ . 1 $Al_2O_3$ . 2.655 $SiO_2$ . 5.2 $H_2O$ |
| Degree of crystallization: | Fully crystalline |
| Calcium binding power: | 145 mg CaO/gm AS |

| Production conditions for aluminosilicate XIIm: | |
|---|---|
| Precipitation: | As for aluminosilicate XII |
| Crystallization: | 6 hours at 90° C. |
| Composition: | 0.9 $Na_2O$ . 1 $Al_2O_3$ . 2 $SiO_2$ . 3 $H_2O$ |
| Degree of crystallization: | Fully crystalline |
| Calcium binding power: | 175 mg CaO/gm AS |

The above-described microcrystalline products IIm and XIIm had a particle size distribution which as determined by sedimentation analysis lay within the following range:

| | |
|---|---|
| >40 μ = 0%<br><10 μ = 85% to 95%<br>< 8 μ = 50% to 85% | Maximum range of the particle size distribution curve at 3 to 6 μ |

The following tables show the composition of five detergents, for the preparation of which the aluminosilicates IIm or XIIm were used according to the process of the invention.

The preparation of the detergents according to Examples 1 and 2 starts from a slurry of the components 1 to 11 which is pasty and contains about 40% free water. This slurry is converted to a fine powder by spraying it into a tower through which hot air at about 260° C. is led countercurrently. During the spray drying, the dry aluminosilicate powder is blown with air into the tower at about the height of the spraying nozzles. Thus, a homogeneous mixture is obtained in which the particles of the blown-in aluminosilicate are agglomerated with the particles obtained by the drying of the aqueous batch. This mixture constitutes the finished detergent in case of Example 1, whereas in the case of Example 2, it is mixed with sodium perborate after the cooling.

The detergents according to the Examples 3 and 4 are prepared by a method similar to the above-described one, except that the substances which in the Table are designated with "O" are introduced into the aqueous slurry and the substances designated with "↓" are introduced as a dry powder. In the case of Example 3, this is also valid for a part of the tripolyphosphate.

For the preparation of the detergent according to Example 5, a part of the non-ionics are sprayed onto a part of the dry aluminosilicate powder, and the free-flowing powder thus obtained is blown into the tower during the spray drying of the remaining components of the aqueous batch.

In the Tables, the following abbreviations are used for the components of the detergents described therein. Insofar as salt-like components are involved, such as salt-like surface-active compounds as well as other salts, they are present as sodium salts.

"ABS"—designates the salt of an alkylbenzenesulfonic acid having 10 to 15, preferably 11 to 13, carbon atoms in the alkyl chain, which acid has been obtained by the condensation of straight-chain olefins with benzene and sulfonation of the alkylbenzene thus obtained.

"HPK-Sulfonate" or "HST-Sulfonate"—designates a sulfonate obtained by the sulfonation with $SO_3$ of the methyl ester of hyrogenated palm-kernel fatty acid (HPK) or the methyl ester of hydrogenated tallow fatty acid (HST).

"OA+x EO" or "TA+x EO"—designate the products obtained by the addition of x mols of ethylene oxide (EO) to one mol of techhical oleyl alcohol (OA) or tallow fatty alcohol (TA) (iodine number=0.5).

"EDTA"—designates the salt of ethylenediaminetetraacetic acid.

"CTMS"—designates the salt of carboxymethyltartronic acid.

"HEDP"—designates the salt of 1-hydroxyethane-1,1-diphosphonic acid.

"DMDP"—designates the salt of dimethylaminomethane-diphosphonic acid.

"CMC"—designates the salt of carboxymethyl cellulose.

TABLE I

| | Component | Weight Percent of Component in the Spray-Dried Detergent According to Example 1 | 2 |
|---|---|---|---|
| 1. | ABS | 1.4 | 4.5 |
| 2. | HPK-Sulfonate | — | 1.0 |
| 3. | OA + 10 EO | 7.6 | 2.3 |
| 4. | $Na_5P_3O_{10}$ | 7.8 | — |
| 5. | CMTS | — | 20.0 |
| 6. | $Na_2CO_3$ | 18.3 | — |
| 7. | $Na_2SiO$ | 5.4 | — |
| 8. | $Na_2O$ . 3.3 $SiO_2$ | — | 6.5 |
| 9. | EDTA | — | 0.2 |
| 10. | CMC | 0.8 | 1.3 |
| 11. | $Na_2SO_4$ | 10.0 | 7.0 |
| 12. | $H_2O$ | 10.3 | 7.2 |
| 13. | Aluminosilicate IIm | 38.4 | 25.0 |
| 14. | $NaBO_2$ . $H_2O_2$ . 3 $H_2O$ | — | 25.0 |

TABLE II

| Component | Weight Percent of Component in the Spray-Dried Detergent According to Example 3 | 4 | 5 |
|---|---|---|---|
| TA + 14 EO | 3.8 | 6.5 | 9.6 (+) |
| TA + 5 EO | 2.2 | 3.5 | 4.4 |
| ABS | 7.0 | — | — |

TABLE II-continued

| Component | Weight Percent of Component in the Spray-Dried Detergent According to Example 3 | 4 | 5 |
|---|---|---|---|
| HST-Sulfonate | — | 2.5 | — |
| Soap $C_{12}$ to $C_{22}$ | 3.4 | — | — |
| Foam Inhibitor | — | 0.8 | — |
| Aluminosilicate IIm O | 12.9 | — | 20.0 |
| Aluminosilicate IIm ↓ | 7.1 | — | 20.0 |
| Aluminosilicate XIIm O | — | 15.0 | — |
| Aluminosilicate XIIm ↓ | — | 15.0 | — |
| $Na_5P_3O_{10}$ O | 2.9 | — | — |
| $Na_5P_3O_{10}$ ↓ | 7.1 | — | — |
| CMTS | — | 8.0 | 13.0 |
| EDTA | 0.3 | 0.3 | — |
| $Na_2O$ . 3.3 $SiO_2$ | 5.0 | 5.0 | 5.0 |
| $Na_2CO_3$ | — | — | 8.5 |
| $NaBO_2$ . $H_2O_2$ . 3 $H_2O$ | 28.5 | 25.0 | — |
| $Na_2SO_4$ | 5.5 | 5.1 | 9.3 |
| $MgSiO_3$ | 2.0 | 2.0 | — |
| CMC | 1.5 | 1.6 | 1.5 |
| $H_2O$ | 10.8 | 9.7 | 8.7 |

(+) As to the 9.6% TA + 14 EO, 7.4% were in the aqueous slurry, whereas 2.2% had been sprayed on the alumino- silicate that had to be blown in.

EDTA can be replaced with the equal quantity of HEDP or DMDP, and $Na_5P_3O_{10}$ can be replaced with an equal quantity of a phosphate substitute that is free from phosphorus, as for example, CMTS or sodium citrate.

The preceding specific embodiments are illustrative of the practice of the invention. It is to be understood, however, that other expedients known to those skilled in the art or disclosed herein may be employed without departing from the spirit of the invention or the scope of the appended claims.

We claim:

1. A process for the manufacture of a low phosphorus or phosphorus-free spray dried detergent powder containing less than 6% by weight calculated as phosphorus, of phosphorus-containing compounds, from 5% to 30% by weight of at least one surface-active compound selected from the group consisting of anionic surface-active compounds, non-ionic surface-active compounds and zwitterionic surface-active compounds of which from 29.5% to 100% by weight of said surface-active compounds are nonionic surface-active compounds, from 15% to 90% by weight of water-soluble builder salts, from 0 to 50% by weight of other detergent powder additives, and from 5% to 50% by weight of at least one finely-dispersed water-insoluble silicate compound containing at least some combined water and having primary particles in the size range of from 100μ to 0.1μ and a calcium binding powder when measured at 22° C. by the Calcium Binding Power Test Method set out in the specification, of from 100 to 200 mg CaO/gm of anhydrous active substance and the formula on the anhydrous basis $$(M_{2/n}O)_x \cdot Me_2O_3 \cdot (SiO_2)_y$$

where M is a cation of the valence n, selected from the group consisting of sodium and potassium, x is a number from 0.7 to 1.5, Me is a member selected from the group consisting of aluminum and boron, and y is a number from 0.8 to 6, comprising the steps of spraying an aqueous slurry of at least 50% by weight of the total solids of the final spray dried detergent, of detergent ingredients, into a fall space while passing a large volume of air therethrough at an inlet temperature in excess of 150° C.

and simultaneously injecting into said fall space, a powder comprising at least 25% by weight of the total amount of said silicate compound, at a rate in proportion to the rate of said spraying whereby the desired total solids ratio of ingredients in said spray dried detergent powder is maintained, and recovering said spray dried detergent powder.

2. The process of claim 1 wherein Me is aluminum.

3. The process of claim 1 wherein M is sodium.

4. The process of claim 1 wherein y is a number from 1.3 to 4.

5. The process of claim 1 wherein said powder injected into said fall space comprising at least 33⅓% by weight of the total amount of said silicate compound.

6. The process of claim 1 wherein said silicate compound is crystalline.

7. A process for the manufacture of a low phosphorus or phosphorus-free spray dried detergent powder containing less than 6% by weight calculated as phosphorus, of phosphorus-containing compounds, from 5% to 30% by weight of at least one surface-active compound selected from the group consisting of anionic surface-active compounds, non-ionic surface-active compounds and zwitterionic surface-active compounds of which from 2.3% to 14% by weight is said nonionic surface-active compounds, from 15% to 90% by weight of water-soluble builder salts, from 0 to 50% by weight of other detergent powder additives, and from 5% to 50% by weight of at least one finely-dispersed water-insoluble silicate compound containing at least some combined water and having primary particles in the size range of from 100μ to 0.1μ and a calcium binding powder when measured at 22° C. by the Calcium Binding Power Test Method set out in the specification, of from 100 to 200 mg CaO/gm of anhydrous active substance and the formula on the anhydrous basis $$(M_{2/n}O)_x.Me_2O_3.(SiO_2)_y$$

where M is a cation of the valence n, selected from the group consisting of sodium and potassium, x is a number from 0.7 to 1.5, Me is a member selected from the group consisting of aluminum and boron, and y is a number from 0.8 to 6, comprising the steps of spraying an aqueous slurry of at least 50% by weight of the total solids of the final spray dried detergent, of detergent ingredients, into a fall space while passing a large volume of air therethrough at an inlet temperature in excess of 150° C. and simultaneously injecting into said fall space, a powder comprising at least 25% by weight of the total amount of said silicate compound, at a rate in proportion to the rate of said spraying whereby the desired total solids ratio of ingredients in said spray dried detergent powder is maintained, and recovering said spray dried detergent powder.

8. A process for the manufacture of a low phosphorus or phosphorus-free spray dried detergent powder containing less than 6% by weight calculated as phosphorus, of phosphorus-containing compounds, from 5% to 30% by weight of at least one surface-active compound selected from the group consisting of anionic surface-active compounds, nonionic surface-active compounds and zwitterionic surface-active compounds of which from 29.5% to 100% by weight of said surface-active compounds are nonionic surface-active compounds, from 15% to 90% by weight of water-soluble builder salts, from 0 to 50% by weight of other detergent powder additives, and from 5% to 50% by weight of at least one finely-dispersed water-insoluble silicate compound containing at least some combined water and having primary particles in the size range of from 100μ to 0.1μ and a calcium binding power when measured at 22° C. by the Calcium Binding Power Test Method set out in the specification, of from 100 to 200 mg CaO/gm of anhydrous active substance and the formula on the anhydrous basis $$(M_{2/n}O)_x.Me_2O_3.(SiO_2)_y$$

where M is a cation of the valence n, selected from the group consisting of sodium and potassium, x is a number from 0.7 to 1.5, Me is a member selected from the group consisting of aluminum and boron, and y is a number from 0.8 to 6, comprising the steps of spraying an aqueous slurry of at least 50% by weight of the total solids of the final spray dried detergent, of detergent ingredients, into a fall space while passing a large volume of air therethrough at an inlet temperature in excess of 150° C. and simultaneously injecting into said fall space, a powder comprising at least 25% by weight of the total amount of said silicate compound, wherein at least part of said non-ionic surface-active compound is combined with said powder comprising said silicate compound in a ratio of from 0.11 to 0.3 parts by weight of said non-ionic surface-active compound per 1 part by weight of said silicate compound, said powder being injected at a rate in proportion to the rate of said spraying whereby the desired total solids ratio of ingredients in said spray dried detergent powder is maintained, and recovering said spray dried detergent powder.

* * * * *